US007806780B1

(12) United States Patent
Plunkett

(10) Patent No.: US 7,806,780 B1
(45) Date of Patent: Oct. 5, 2010

(54) ROBOTIC GOLF SWING TRAINER

(76) Inventor: Jim B. Plunkett, 147 Manor La., Ft. Thomas, KY (US) 41075

( * ) Notice: Subject to any disclaimer, the term of this patent is extended or adjusted under 35 U.S.C. 154(b) by 0 days.

(21) Appl. No.: 12/621,760

(22) Filed: Nov. 19, 2009

Related U.S. Application Data

(60) Provisional application No. 61/116,432, filed on Nov. 20, 2008.

(51) Int. Cl.
*A63B 69/36* (2006.01)

(52) U.S. Cl. ..... 473/257; 473/229

(58) Field of Classification Search ..... 473/219, 473/226, 229, 257, 258, 259, 260, 261, 266
See application file for complete search history.

(56) References Cited

U.S. PATENT DOCUMENTS

| | | | | |
|---|---|---|---|---|
| 1,567,530 | A | 12/1925 | MacNaughton et al. | |
| 1,960,787 | A * | 5/1934 | MacStocker | 473/229 |
| 2,084,901 | A * | 6/1937 | Eisenberg | 473/229 |
| 2,653,025 | A | 9/1953 | Zega | |
| 2,723,858 | A * | 11/1955 | Chizewski | 473/229 |
| 3,132,865 | A * | 5/1964 | Parker | 473/229 |
| 3,795,399 | A | 3/1974 | Beckish | |
| 3,876,212 | A | 4/1975 | Oppenheimer | |
| 4,903,968 | A | 2/1990 | Hargrave | |
| 5,439,225 | A | 8/1995 | Gvoich et al. | |
| 5,467,993 | A | 11/1995 | Higginson | |
| 5,595,545 | A | 1/1997 | O'Brien | |
| 5,984,798 | A | 11/1999 | Gilmour | |
| 6,277,030 | B1 | 8/2001 | Baynton et al. | |
| 6,793,585 | B1 | 9/2004 | Miyamoto et al. | |
| 6,855,065 | B1 | 2/2005 | Hamilton | |
| 6,981,876 | B2 | 1/2006 | Bleckley et al. | |
| 6,988,957 | B2 | 1/2006 | Bender | |
| 7,150,683 | B2 | 12/2006 | Bender | |
| 7,364,512 | B2 | 4/2008 | Graedener | |
| 7,670,233 | B2 * | 3/2010 | Jones | 473/257 |
| 2002/0082106 | A1 | 6/2002 | Gzaja | |

* cited by examiner

*Primary Examiner*—Nini Legesse
(74) *Attorney, Agent, or Firm*—Wood, Herron & Evans, LLP

(57) ABSTRACT

A robotic golf swing trainer according to embodiments of this invention moves a golf club a golfer is holding in the same way as a modeled, well-executed swing such as that of a selected professional golfer. This robotically controlled movement is performed at a multitude of speeds up to and including real time identical speed as the modeled swing, if desired. Additionally, the controlled movement of the club is accomplished so as to not interfere with or touch the golfer in any way during the swing.

16 Claims, 10 Drawing Sheets

ROBOTIC GOLF SWING TRAINER

This claims the benefit of U.S. Provisional Patent Application Ser. No. 61/116,432, filed Nov. 20, 2008 and hereby incorporated by reference in its entirety.

BACKGROUND OF THE INVENTION

This invention relates generally to the game of golf and, more particularly, to a system and associated method for improving one's golf swing.

The golf swing is a simple appearing move to those who have never attempted same. In spite of all the advances in golf clubs and balls, the handicap of the average golfer in the United States has not improved by a single stroke in the last 40 years. It is apparent that truly productive advances in proficiency in the sport must come from better instruction and training. The well-executed golf swing is a carefully timed kinematic sequence of 235 muscles moving 108 bones connected by eight 360 degree joints, thirty-four 180 degree joints and four 90 degree joints trying to control an asymmetrical club head attached to a long flexible shaft in an attempt to hit a small spherical ball at tolerances closer than ½ inch in three-dimensional space at sufficient force to propel aforementioned ball further than one could achieve by simply throwing it. The golf swing can be broken down into a series of problems, the solutions to which on a consistent basis result in a correct and efficient golf swing.

The golf club consists of a club head connected to a shaft which is held by the golfer's hands at the end or grip portion and is swung in a generally circular motion around the golfer's body to strike the golf ball at the low point of the swing. If the golfer had only one pivot point to the ground and only one series of levers that attached to the club shaft (one leg from ground to torso and one hand, arm from torso to club) the golf swing would be far easier to understand and perhaps to repeat, albeit with a loss of power. When analyzing the typical golfer however, one must consider that the club is connected to the torso by two hands and two arms. Additionally, the connection of the torso to the ground is through two legs. While the arms still move the club head in an arcuate path around the golfer's body, this path is far from perfectly circular due to the fact that the golfer's center of gravity shifts from approximately center of the feet to the right foot and right side on the backswing and back through center and onto the left side during the downswing and follow through. This creates a corresponding shift in the epicenter of the arms, hands, shaft, and club head during the swing. In addition, the two hands, two arms model does not provide for swinging the club back and through at full arm extension at all times during the swing but, rather shares the fully extended hands, arm lever on the backswing using the left hand to arm to shoulder pivot on the backswing and moves this hands, arm, shoulder pivot to the right hand, arm, and shoulder gradually on the downswing and follow through.

This complex shifting of the golfer's weight and, hence, pivot of the torso, leg, and ground combined with the shifting pivot points of the hands, arms, shoulder, and torso during the swing correspondingly shifts the epicenter of the arcuate motion of the club head. The hands allow both a hinging of approximately 90 degrees away from the target on the backswing and 90 degrees toward the target on the down swing and follow through. Finally, the hands also concomitantly allow the club shaft to rotate along its longitudinal axis clockwise approximately 90 degrees on the backswing and thereafter 180 degrees counterclockwise through the downswing and follow through. Because the arms also move up as they move around the body to swing the club, the shaft cannot stay on a single plane as it moves around and back through. Rather, the shaft must at all points in the swing follow a series of constantly changing planes which are each parallel to the original plane of the shaft where the golfer initially addresses the ball. Finally, in the well-executed swing, a sequential kinematic acceleration and deceleration of the legs followed by the torso, arms and hands eventually lead to maximum acceleration of the club head at the bottom of the swing for ball impact.

There are numerous prior art swing trainers, devices or systems and many use some variation of a track to help the golf golfer learn the path of the golf club during a swing. Unfortunately, the well-executed golf swing does not follow a single plane or path and training devices or systems using fixed tracks alone fail to provide the progressively higher and lower, but generally parallel, planes required in the efficient and correct path of the golf club shaft.

Stationary single track swing trainers in the prior art fail to properly duplicate the above-described intricate movements of a proper golf swing and fail to allow for the additional linear motion and the correspondingly changing epicenter of the arcuate path as well as the continuously changing, but parallel planes, the shaft must follow as the club is swung back and up, forward and down and finally, forward and up.

SUMMARY OF THE INVENTION

These and other shortcomings in the prior art have been overcome and such objectives have been achieved by this invention, which in one embodiment is a robotic swing trainer which moves a golf club a golfer is holding in the same way as a modeled, well-executed swing such as that of a selected experienced or professional golfer. This robotically controlled movement is able to be performed at a multitude of speeds up to and including real time identical speed as the modeled swing, if desired. Additionally, the controlled movement of the club is accomplished so as to not interfere with or touch the golfer in any way during the swing.

To recreate the movement of a well-executed golf swing, this invention in one embodiment moves a carriage via a large computer driven servo motor on a circular track. A robotic arm is mounted on this carriage that connects the golf club to the carriage. The arm moves in two axes about its base from rest on plane with the carriage (and circular track) vertically to a +45 degree and rotationally +40 degrees to −30 degrees. The distal end of the arm moves the club handle in a mirror image within the plane of the carriage in two axes from −45 degrees and rotationally +90 degrees to −90 degrees. Additionally, the distal connection to the club rotates the club head about its shaft from +90 degrees to −90 degrees.

Without any interference from the golfer, a golf club is swung back on the carriage at maximum golfer speed and acceleration with the supplied carriage transmission. The movement of the golf club handle up, away from the carriage on plane of the track is accomplished with small amounts of power, speed and torque. The rerouting of the handle down, back on plane to the starting point at the bottom requires only slightly more power and torque since we have gravity and centrifugal force as aides. Any force the golfer may use inadvertently in inhibiting/aiding the servo motors in the training swing is accounted for within this invention. Obviously, the golfer will be instructed to remain as inactive as possible and to follow the training robot's direction while gripping and swinging the club.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
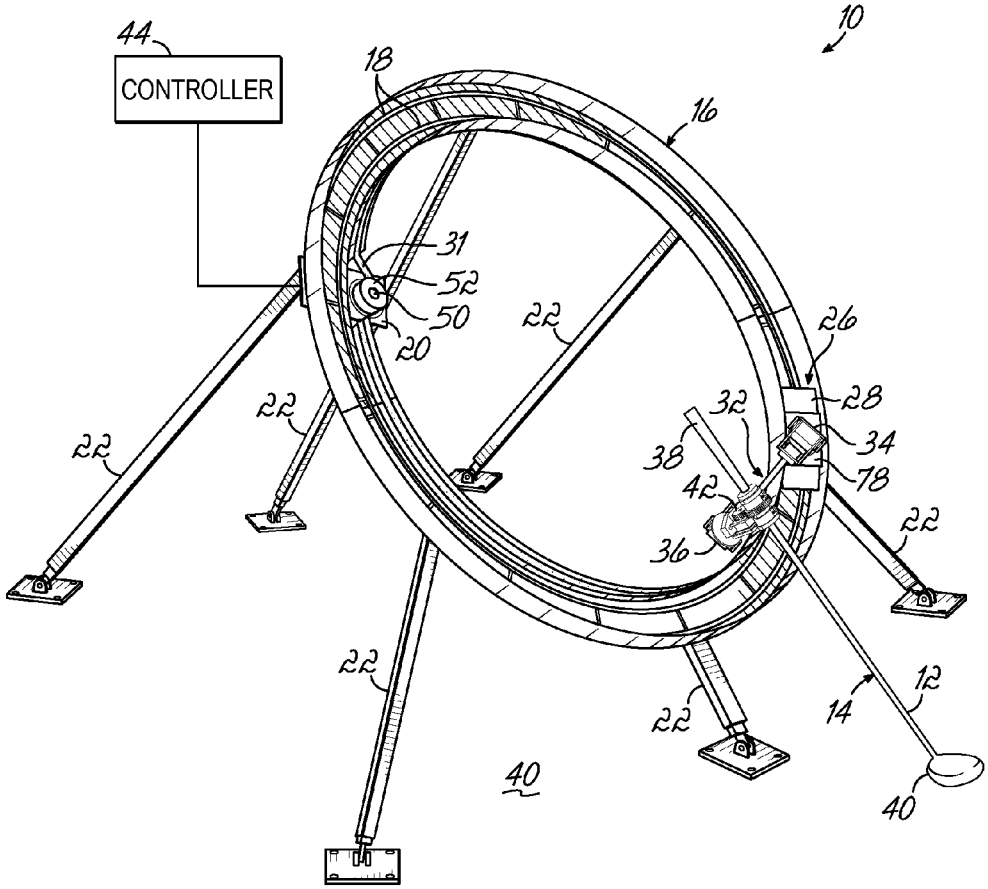
FIG. 1 is a perspective view of one embodiment of a robotic golf swing trainer according to this invention.
Figure 2:
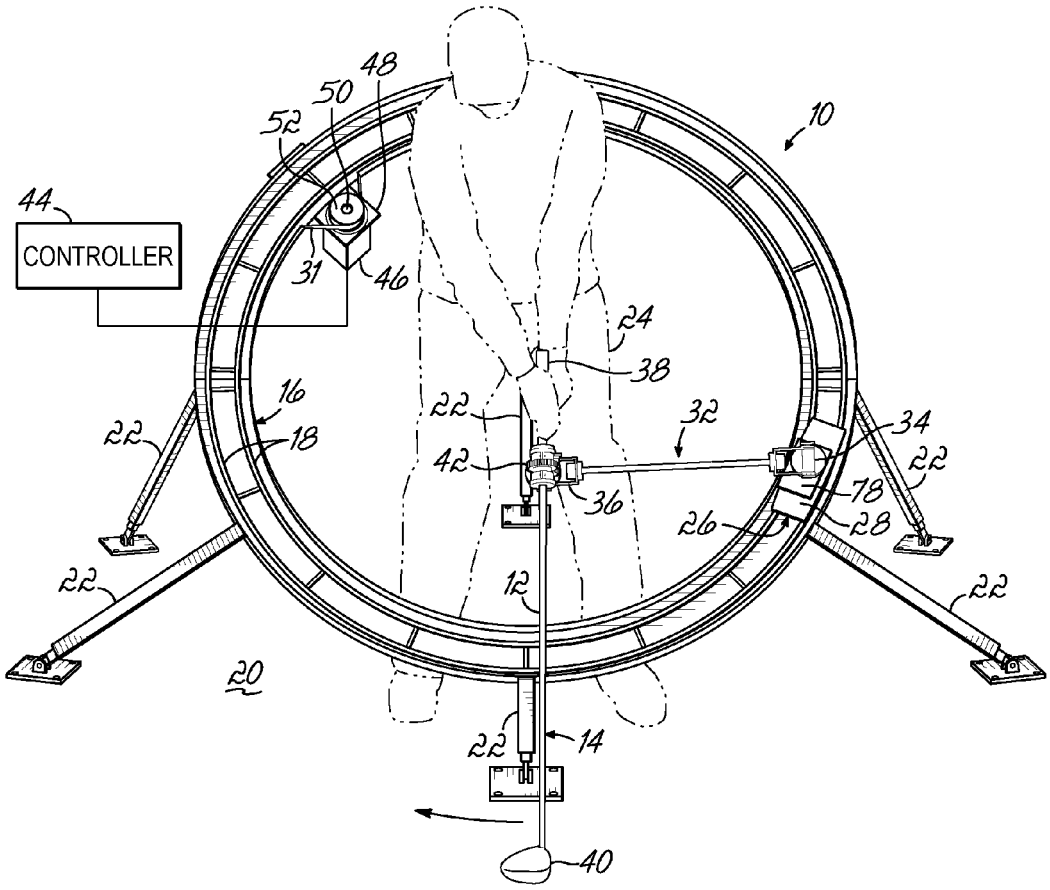
FIG. 2 is a front perspective view of the golf swing trainer of FIG. 1 with a golfer gripping a golf club and appropriately positioned to address a golf ball.
Figure 3:
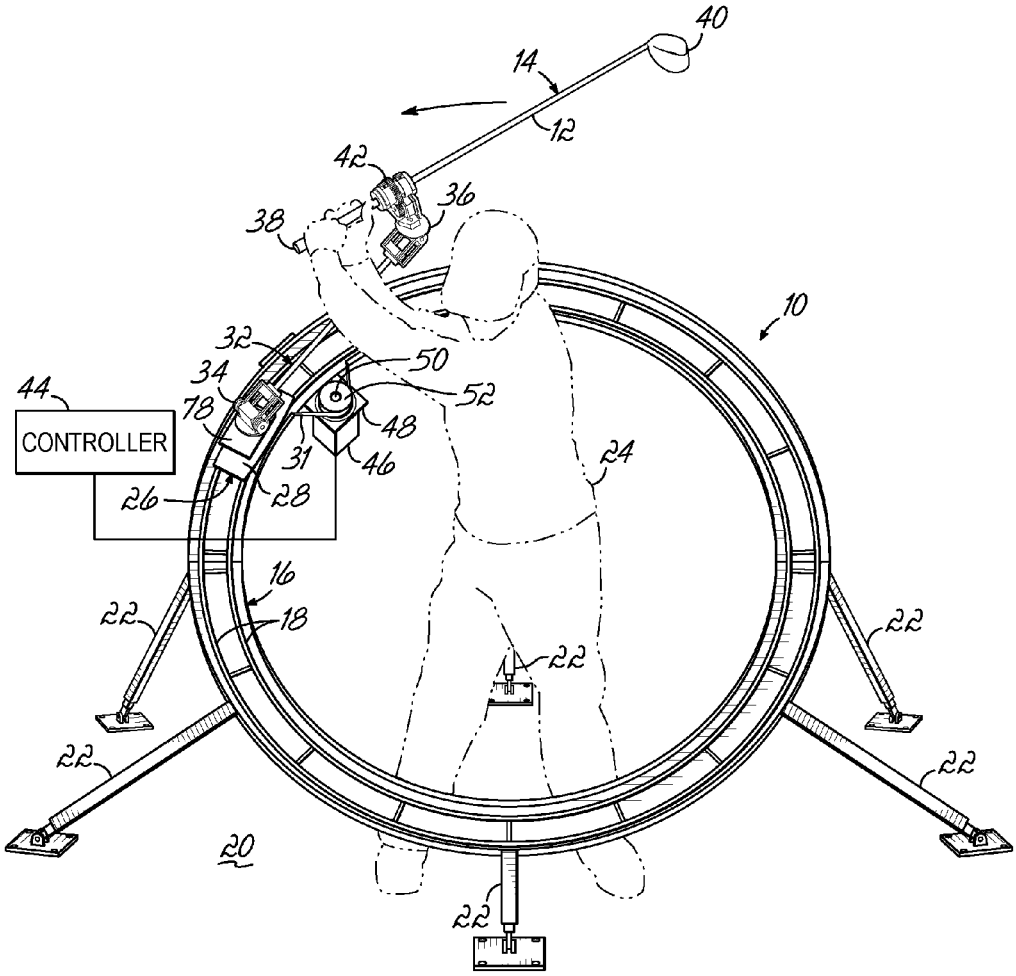
FIG. 3 is a view similar to FIG. 2 during a backswing motion of the golf swing trainer and golfer.
Figure 4:
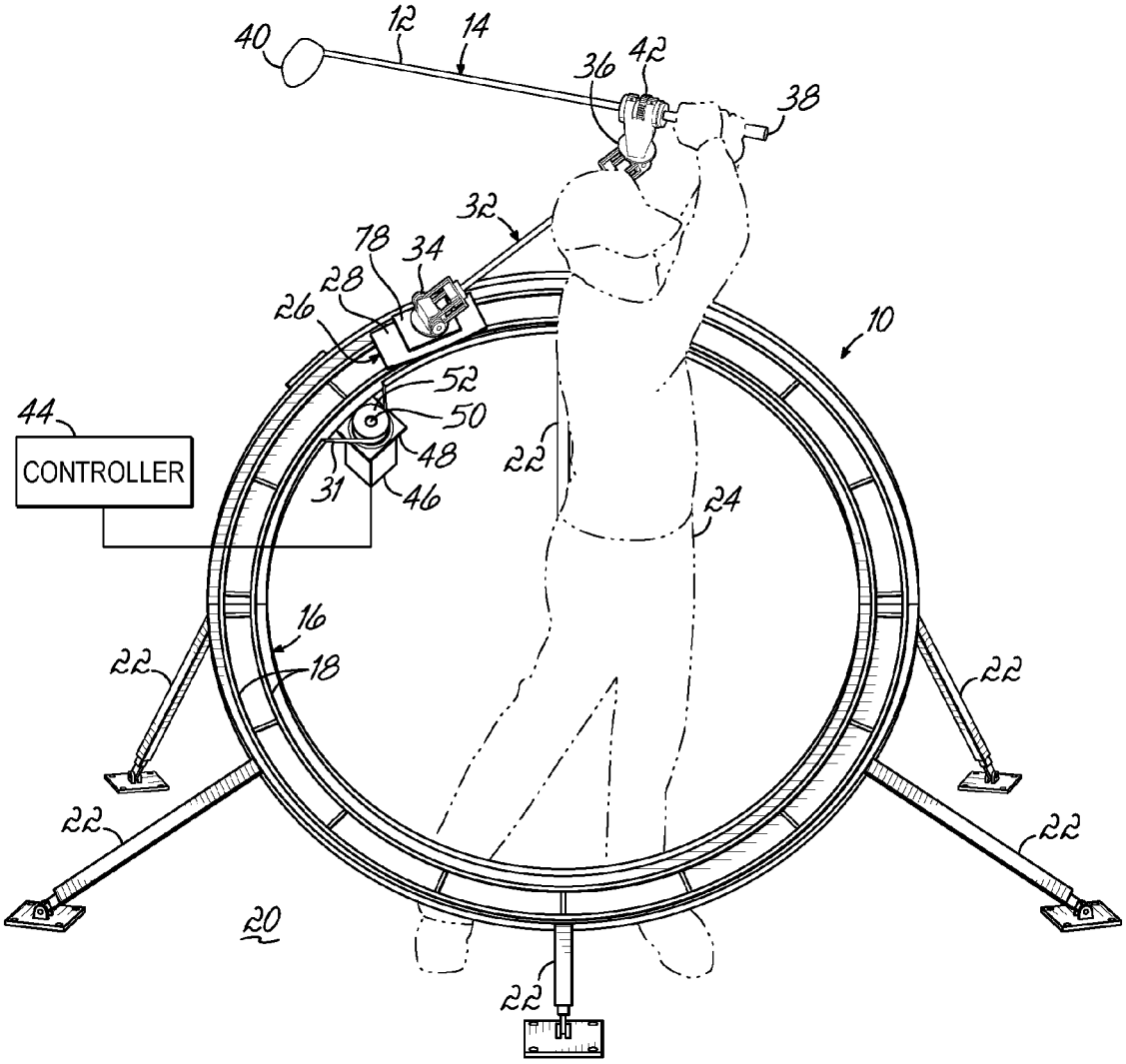
FIG. 4 is a view similar to FIG. 3 during a follow through motion of the golf swing trainer and golfer.

Referring initially to FIGS. 1-4, one embodiment of a unique golf swing trainer 10 allows for input and output of curvilinear, linear and rotary movement of a shaft 12 of a golf club 14 via electro mechanical servo motors connected to a track 16. A circular track 16 which in one embodiment has an 82 cm radius with one or more rails 18 is connected to the ground 20 via a system of supporting and telescopically adjustable legs 22, six of which are shown, allowing the circular track 16 to be adjustable in degrees from vertical and in height to match the frame of an individual golfer 24 and the initial shaft angle at golf ball address. A carriage 26 which in one embodiment measures about 15×25 cm moves along the track 16 and includes a carriage plate 28. Rollers 30 on the carriage 26 allow it to move in a curvilinear motion along the track rails 18 powered by a timing belt 31 driven by a servo motor. A robotic arm 32 which in one embodiment is about 80 cm long is attached to this carriage 26 that allows for relative motion at its proximal or base end 34. The distal end 36 of the robotic arm 32 is attached to the grip end 38 of the golf club 14 in such a way that also allows for motion of the club head 40 during the golf swing, including about the longitudinal axis of the golf shaft 12. The robotic arm 32 is attached to the golf club 14 at the upper end of the shaft 12 just below the grip 38 by an end effector 42 to allow the golfer 24 access to properly grip the club 14.

There are multiple articulations/joints of the robotic arm 32, each of which is accomplished by individual servo motors controlled by a computer controller 44. The controller 44 coordinates the servo motors of the robotic arm 32 and the servo motor driving the carriage 26 on which the arm 32 is attached. In this manner, the golf club 14 can be moved in all required dimensions for a desired golf swing including club face rotation by computer control of the servo motors.

Figure 5:
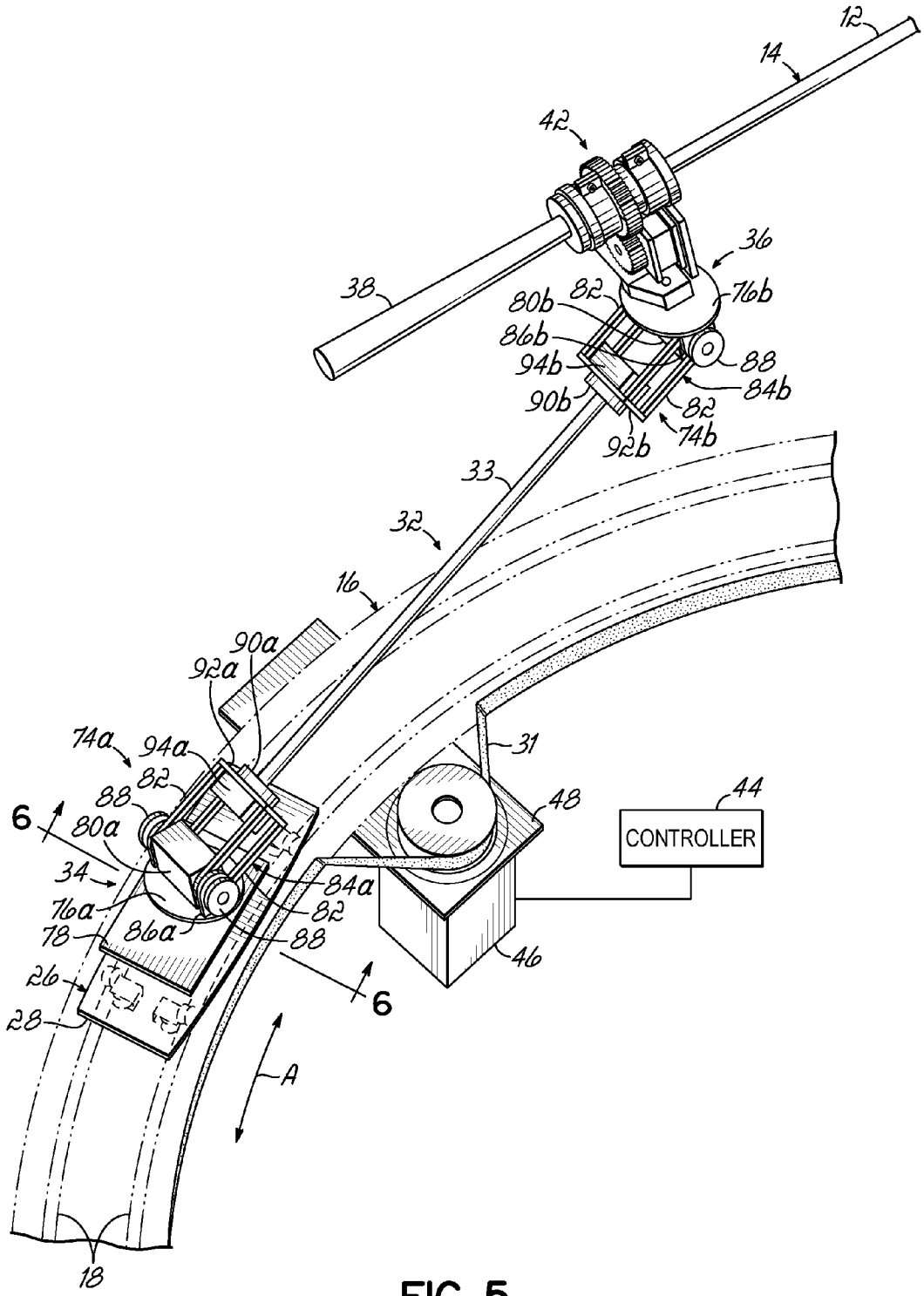
FIG. 5 is a view of a robotic arm gripping the golf club and coupled to a track of the golf swing trainer of FIG. 1.

Referring to FIG. 5, a portion of the track 16 with the carriage 26 and robotic arm 32 gripping the shaft 12 of the golf club 14 is shown. As previously mentioned, the carriage 26 is movable along the track 16 by a belt 31 driven by a servo motor 46 supported on the track 16 by a mounting plate 48. The servo motor 46 includes a rotating shaft 50 with a pulley 52 mounted thereon. As shown in FIG. 5, the belt 31 is trained around an arc of the circumference of the pulley 52 and once the servo motor 46 and the shaft 50 drive the pulley 52 in either of two rotary directions as shown by arrow A in FIG. 5, the belt is likewise moved relative to the track 16. The carriage 26 is coupled to the belt 31 so that the carriage 26 is driven around the track 16 by the servo motor 46.

Figure 6:
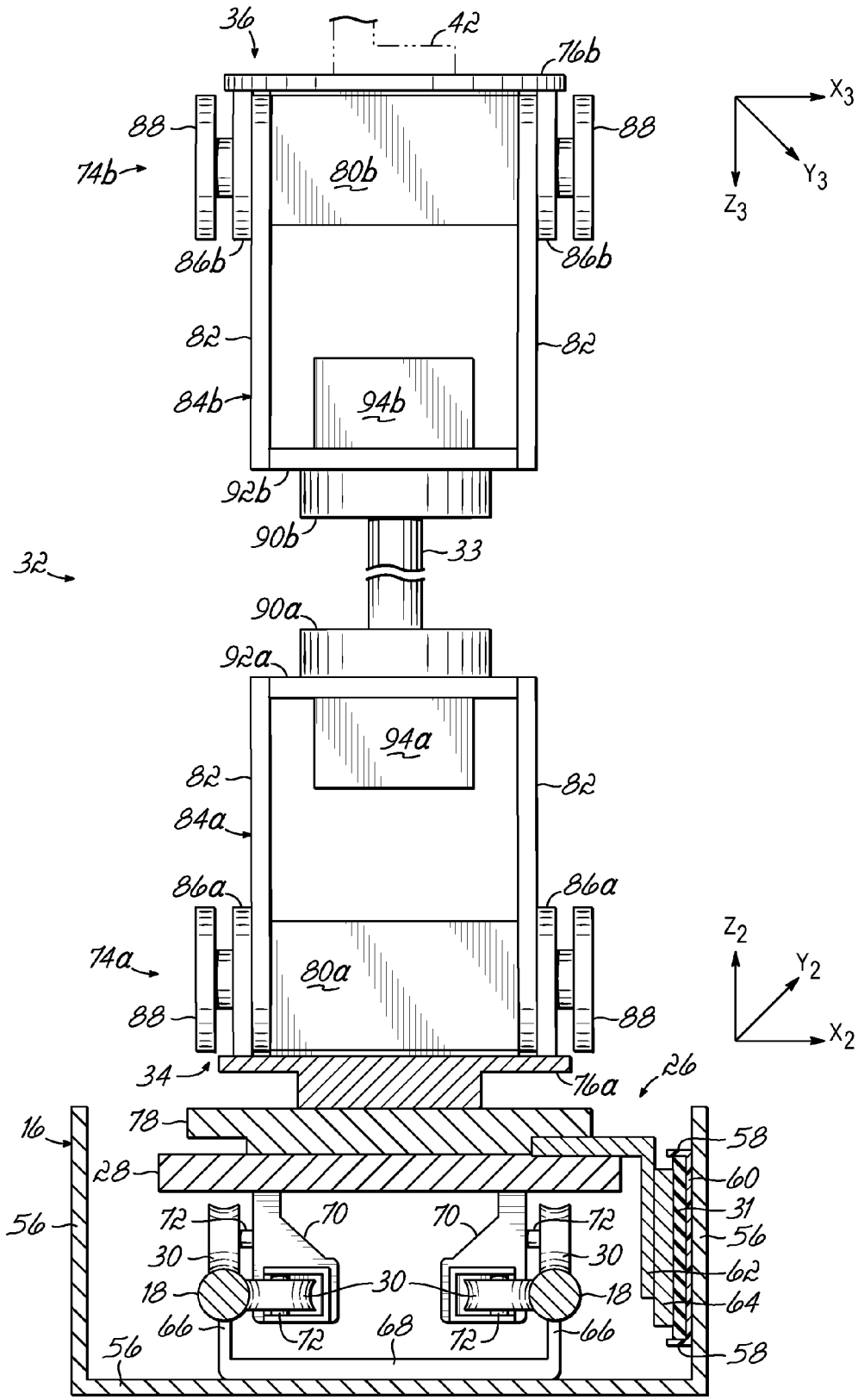
FIG. 6 is a cross-sectional view taken along line 6-6 of FIG. 5 of a carriage coupled to the robotic arm for movement along the track.

As shown in FIG. 6, the track 16 includes a generally U-shaped cross-sectional configuration with a base 54 and a pair of spaced upstanding sidewalls 56. The belt 31 is seated relative to the inner sidewall and is constrained from vertical movement by upper and lower flanges 58 of a bracket 60. An L-shaped brace 62 in cross section couples the carriage 26 to mounting block 64 on the belt as shown in FIG. 6.

With continuing reference to FIG. 6, the two rails 18 are shown mounted to the track 16 on terminal ends 66 of a U-shaped mount 68. A pair of roller hubs 70 extends downwardly from the carriage plate 28 and each roller hub 70 has a pair of the rollers 30 each mounted on an axle 72 for rotation. The rollers 30 mounted on each hub 70 are in a generally perpendicular orientation to one another with the vertically oriented roller positioned on top of the respective rail 18 as shown in FIG. 6; whereas the horizontally oriented roller 30 is mounted on an interior of the associated rail 18. Each roller 30 has a concave peripheral surface for engaging the rail 18 and the carriage roller assembly as shown in FIG. 6 retains the carriage 26 to the rails 18 during movement of the carriage 26 along the track 16. It is readily appreciated by one of ordinary skill in the art that alternative arrangements for the rollers and carriage assembly are possible within the scope of this invention.

FIGS. 5 and 6 also show one embodiment of the robotic arm 32 according to this invention. The robotic arm 32 includes a pair of servo motor arrangements 74*a*, 74*b*, one 74*a* of which is mounted at the proximal end 34 of the robotic arm 32 and the other 74*b* of which is mounted at the distal end 36 of the robotic arm 32. The servo motor arrangements 74*a*, 74*b* are mirror images of one another and each includes two servo motors which are adapted to move the robotic arm 32 in respective planes perpendicular to one another. Each servo motor arrangement 74*a*, 74*b* is coupled to the robotic arm 32 at one end and an opposite end of the servo motor arrangement is mounted to a disc-shaped mounting plate 76*a*, 76*b*, respectively. The proximal servo motor arrangement 74*a* is mounted to the disc-shaped mounting plate 76*a* which is adapted for rotational movement relative to a plate 78 mounted to the carriage plate 28 as shown in FIGS. 5 and 6. The pair of servo motors for the proximal servo motor arrangement is in a housing 80*a* and one servo motor of the proximal servo motor arrangement 74*a* rotates the disc-shaped mounting plate 76*a* relative to the plate 78 for movement of the robotic arm within the $X_2$-$Y_2$ plane as shown in FIG. 6. The proximal servo motor arrangement 74*a* also includes a servo motor in the housing 80*a* mounted between the extending legs 82 of a frame 84*a* for movement of the robotic arm 32 within a plane identified by $Z_2$-$Y_2$ in FIG. 6. The frame 84*a* includes two pair of spaced legs 82 on opposite sides of the motor housing 80*a* mounted to a yoke 86*a* having a pair of discs 88 mounted on the outer periphery of the frame 84*a*. The robotic arm 32 extends from a hub 90*a* on an upper mounting plate 92*a* of the frame 84*a*. The hub 90*a* and mounting plate 92*a* are mounted atop a case 94*a* in the frame 84*a*.

The distal servo motor arrangement 74*b* is a mirror image of the proximal servo motor arrangement 74*a* with the end effector 42 mounted distally on the disc-shaped mounting plate 76*b* as shown in FIG. 6. A shaft 33 of the robotic arm extends between hubs 90*a* and 90*b* on the proximal and distal servo motor arrangements 74*a*, 74*b*, respectively. The distal servo motor arrangement 74*b* includes a servo motor housing 80*b* with a pair of servo motors within housing 94*b*, one of which is adapted to move the end effector 42 within the $X_3$-$Y_3$ plane as well as an additional servo motor for movement within the $Z_3$-$Y_3$ plane as referenced in FIG. 6.

The robotic arm is about 82 cm long with its proximal end connected to the carriage 26 to satisfy biometric restrictions. The distal end attaches to the golf club shaft 12. The arm's proximal servo arrangement 74*a* has a two servo motor combination that rotates the arm 32 as a turntable parallel via the disc plate 76 to the plane of the carriage plate 28 from a center measured tangent to the track 16 +30 degrees to −30 degrees. The arm 32 also rotates vertically from +10 degrees to +40 degrees from perpendicular. A two servo combination is included also in the distal servo arrangement 74*b* at the end of the arm 32 that serves the same motion requirements of those at the proximal end, but in reverse order, namely, rotation perpendicular to carriage plate −40 to −30 degrees and rotation around the carriage plate as a turntable, but to a larger degree −120 degrees to +120 degrees. The fifth axis is at the distal end of the arm 32 and served by servo motor 102 that rotates the club head 40 about the longitudinal axis of the golf shaft +120 degrees to −120 degrees.

Figure 7:
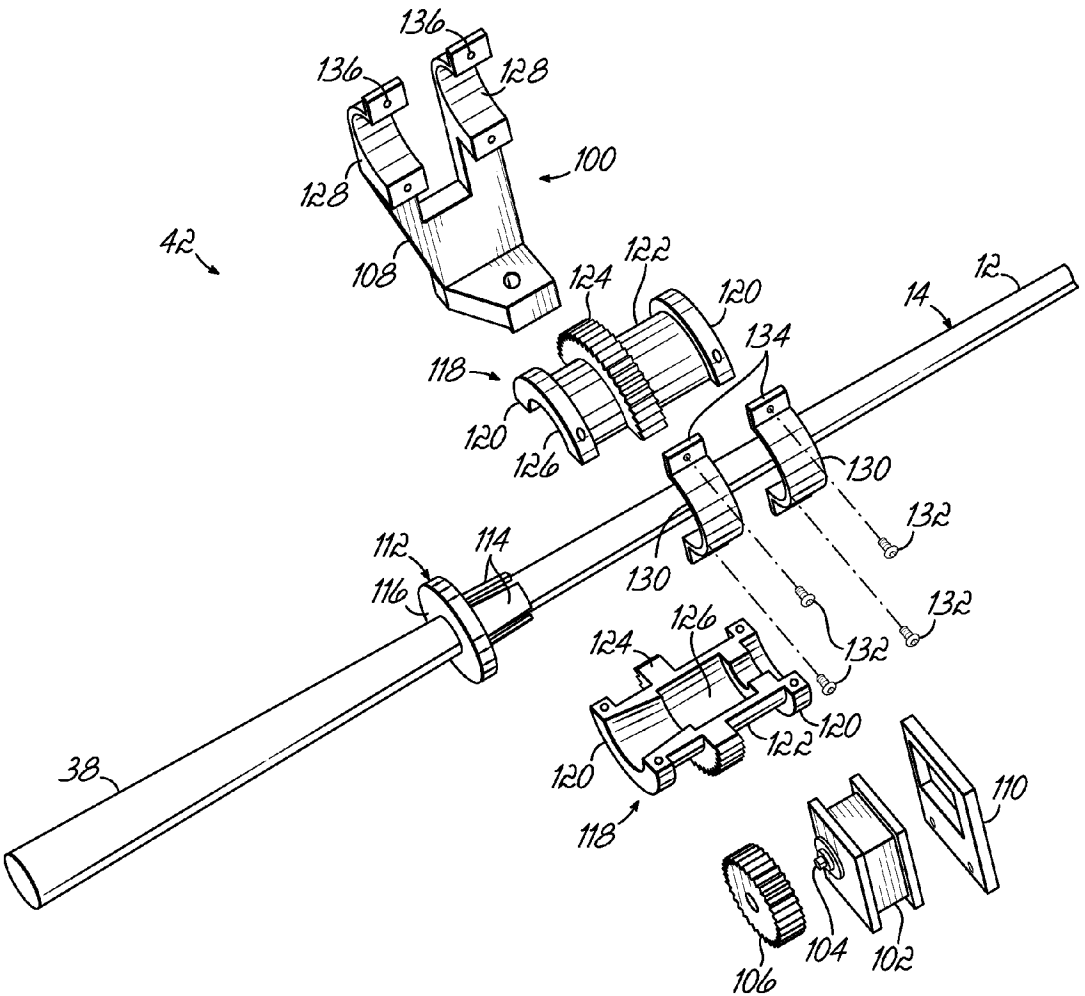
FIG. 7 is an exploded view of the components of an end effector for gripping the golf club according to the golf swing trainer of FIG. 1.
Figure 8:
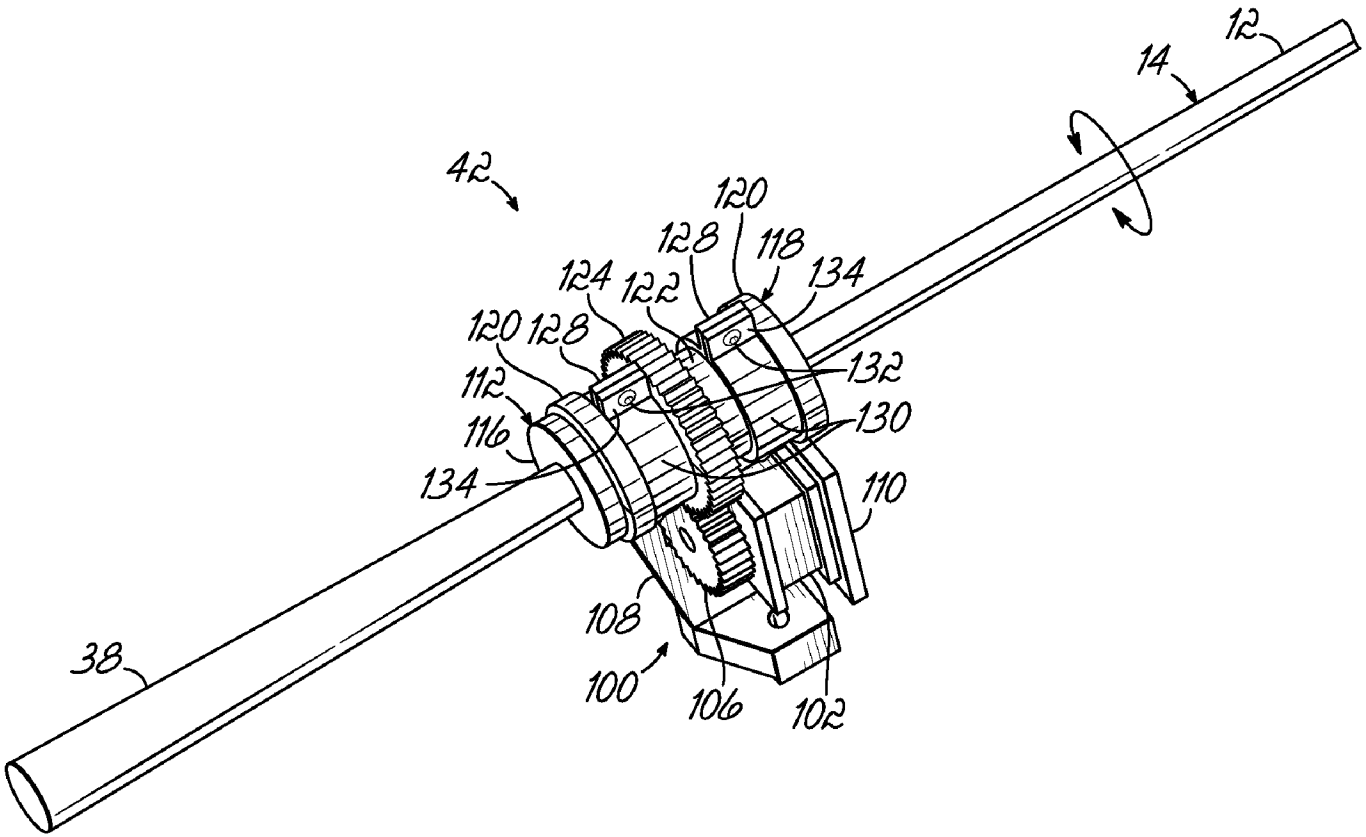
FIG. 8 is a view similar to FIG. 7 with the components assembled on the golf club.

The end effector 42 and associated components are shown particularly in FIGS. 7 and 8. The end effector 42 includes a mounting bracket 100 which is secured to the disc-shaped mounting plate 76*b* of the distal servo motor arrangement 74*b*. The end effector 42 also includes a servo motor 102 having a rotating shaft 104 with a spur gear 106 mounted thereon. The servo motor 102 is mounted to a body portion 108 of the mounting bracket 100 with a servo motor mounting plate 110 oriented perpendicularly to the body portion 108. The end effector 42 includes a collar 112 mounted to the shaft 12 of the golf club 14 just below the grip 38 with a number of tabs 114 projecting longitudinally along the shaft 12 and extending from an annular portion 116 of the collar 112 as shown particularly in FIG. 7.

The end effector 42 also includes a split spindle 118 having two pieces which when joined together capture the collar 112 and shaft 12 of the golf club 14. Each piece of the spindle 118 includes a pair of hemispherical flanges 120 projecting at opposite ends from a core 122 of the spindle 118. Positioned intermediate the hemispherical flanges 120 on each spindle piece is a ring gear hemispherical portion 124. Each spindle piece 118 has a contoured socket 126 adapted to receive the collar 112 and shaft 12 of the golf club 14 when the spindle pieces 118 are joined together around the golf club 114 as shown in FIG. 8. The core 122 of the spindle 118 is seated within a pair of hemispherical-shaped cradle portions 128 of the mounting bracket 100. When the spindle 118 is assembled on the shaft 12 and the collar is seated within the cradles 128 of the mounting bracket 100, a pair of stirrup shackles 130 is mounted to the cradle 128 and around the spindle 118 to retain the assembly on the mounting bracket 100. Screws or other mechanical fasteners 132 are used to secure terminal ends 134 of the stirrup shackle 130 to screw holes 136 bordering the cradle portions 128 of the mounting bracket 100 as shown particularly in FIG. 8. When the end effector 42 is assembled as shown in FIG. 8, the ring gear 124 portions of the spindle 118 mesh with the spur gear 106 mounted on the servo motor 102 to selectively rotate the spindle 118 and, as such, the shaft 12 of the golf club 14 captured by the spindle 118 about the longitudinal axis of the shaft 12 as shown by the arrow in FIG. 8.

The end effector 42 attaches to a golf club shaft 12 just below the grip 38. The starting position of this assembly is 15 cm above and perpendicular to the circular track. The assembly must be able to move:

i. Circumferentially along the track from stop (0 degrees) accelerating up to 180 cm/sec then decelerating to stop at +180 degrees then accelerating to speeds of 650 cm/sec through 0 degrees decelerating to stop at −180 degrees. This is provided by the movement of the carriage along the circular track on an inclined fixed plane;

ii. 75 cm above the track staying on a plane at all times parallel to the track plane at a speed of 180 cm/sec;

iii. 35 cm tangentially away from the track parallel to track plane at speed of 180 cm/sec;

iv. Rotate +120 degrees to −120 degrees in a plane parallel to the plane of the track at a rate of 400 degrees/sec;

v. Rotate about its longitudinal axis +120 to −120 degrees at a rate of 400 degrees/sec.

In one embodiment, an axis biomechanics robotic arm compatible for use with the golf swing trainer 10 according to this invention can be obtained from Energid Technologies Corporation (www.energid.com).

The robotic arm 32 is mounted on the carriage 26 traveling on a circular track about 164 cm in diameter. The carriage/arm assembly will accelerate from zero to 15 mph over the first quarter of the circumference of the track and decelerate over the $2^{nd}$ quarter to a dead stop at the top. From the top, the carriage/arm assembly will then accelerate from zero to 15 mph as the carriage 26 is moved (pulled) by the belt 31 driven by the large computer controlled servo motor 46. The robotic arm's 32 associated control and power cables may run along the distal end of the robotic arm 32 and then along the golfer's hands/arms/torso/legs to the ground 20 obviating any need to accommodate cables along the track 16.

As will be appreciated by one of ordinary skill in the art, the embodiment of the golf swing trainer 10 as shown in FIGS. 1-8 herein could be used for any club 14 including a putter. However, minor inaccuracies may arise when using the golf swing trainer 10 shown in FIGS. 1-8 with a putter, but such inaccuracies will not be significant.

Figure 9:
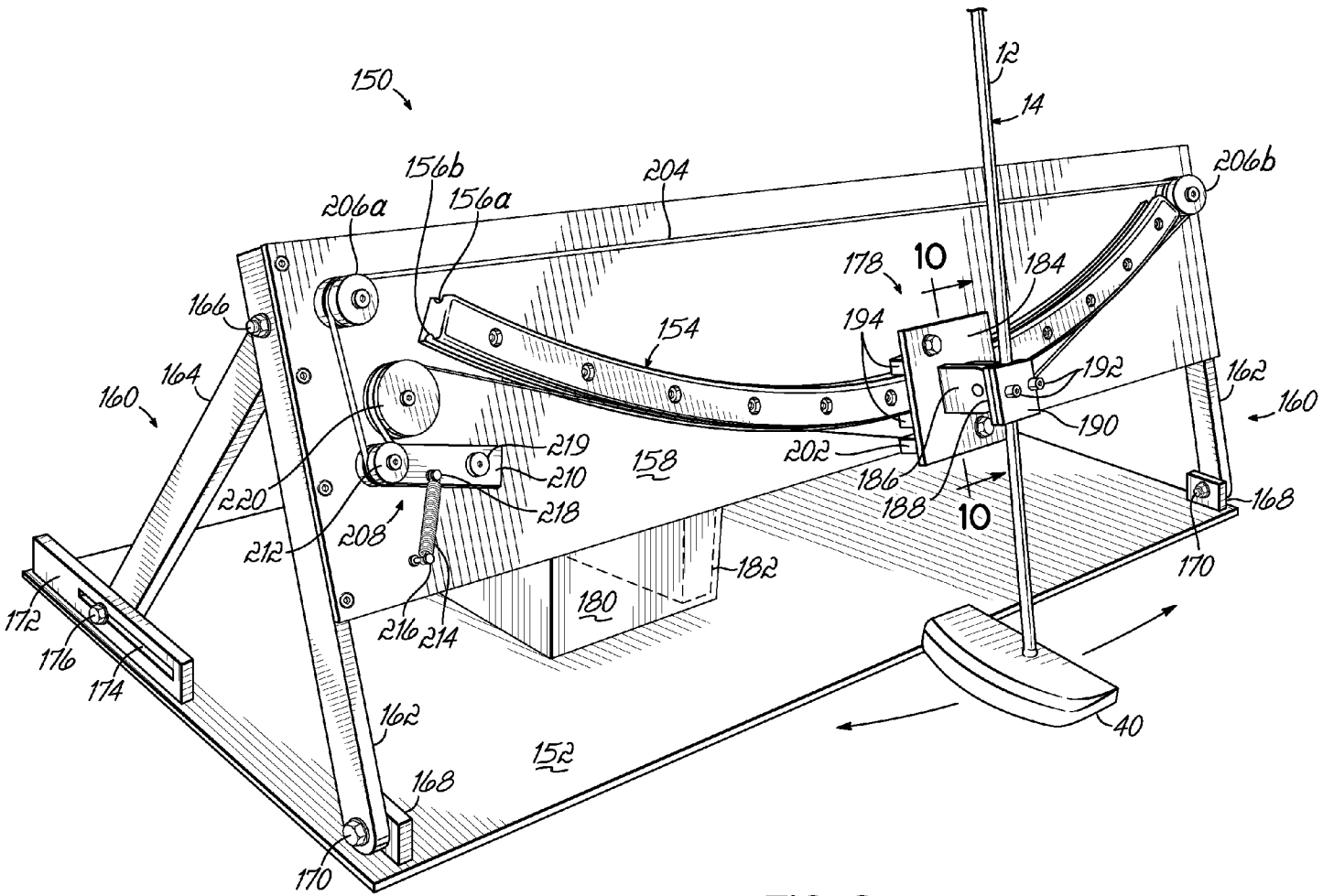
FIG. 9 is a perspective view of another embodiment of a golf swing trainer according to this invention adapted for a putting stroke.
Figure 10:
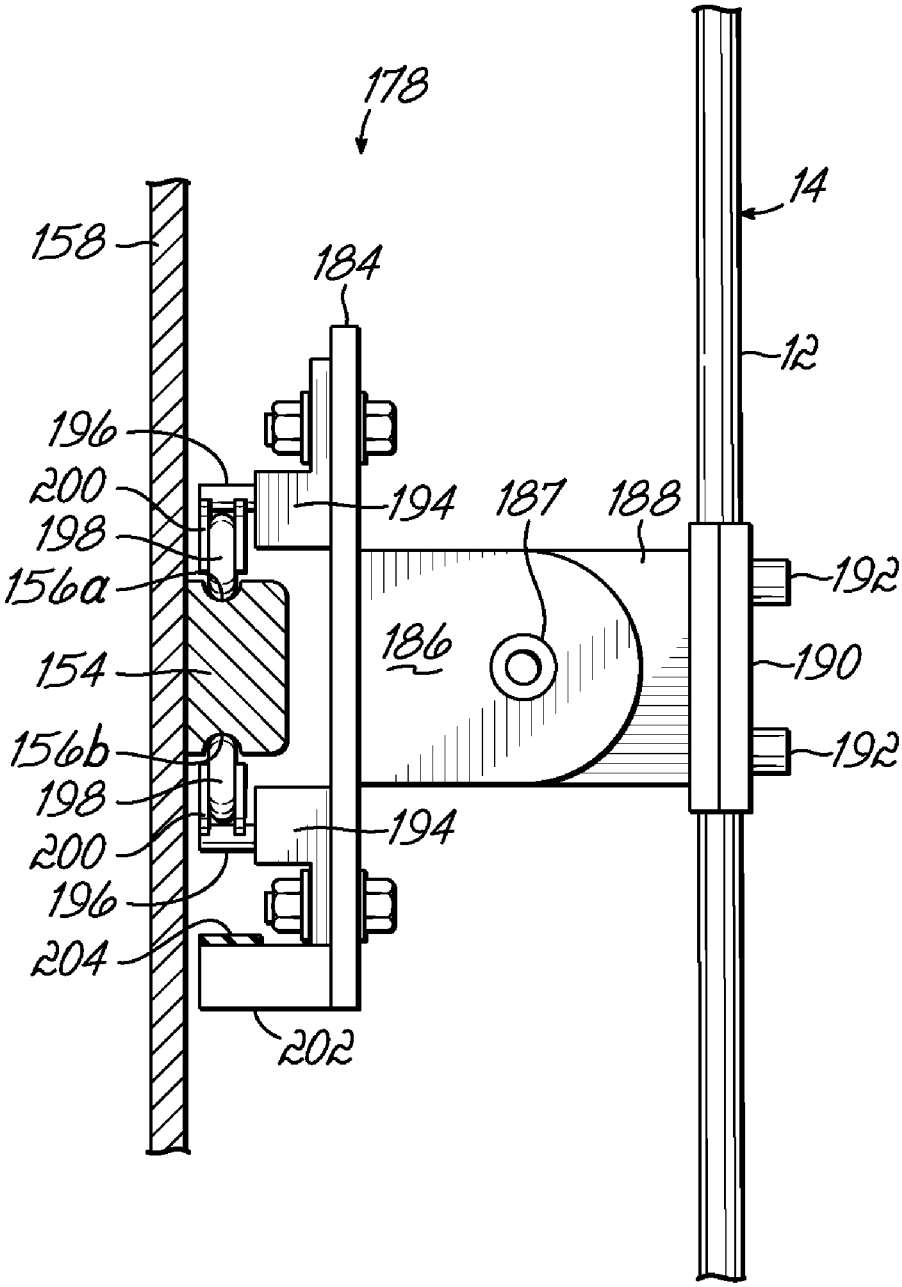
FIG. 10 is a cross-sectional view taken along line 10-10 of FIG. 9 of a carriage coupled to a putter for movement along a track.

Another embodiment of a golf swing trainer 150 according to this invention is shown in FIGS. 9 and 10 which is particularly adapted for shorter golf strokes, including the putting stroke. Referring to FIG. 9, the golf swing trainer 150 of this embodiment is mounted to a base plate 152 which is typically ground supported. A curvilinear or arcuate track 154 is adjustably mounted to the base plate 152. The track 154 has upper and lower grooves 156*a*, 156*b* formed in the side edges of the track 154 which is bolted or screwed at a number of locations to a track mounting plate 158. The track mounting plate 158 is supported by left and right brace assemblies 160 only one of which is shown in detail in FIG. 9, but each brace assembly 160 is a mirror image of the other. The brace assembly 160 includes front and rear braces 162, 164 which are pivotally joined to each other by a bolt and nut combination 166 near and upper outer edge of the track mounting plate 158. The lateral edge of the track mounting plate 158 is bolted or screwed to the front edge of the front brace 162 and a lower end of the front brace 162 is pivotally mounted to a mounting block 168 projecting upwardly from the base plate 152 by a mechanical fastener 170 such as a bolt and nut combination, screw or the like. The rear brace 164 is coupled to a slide mount 172 projecting upwardly from the base plate 152 at an outer lateral edge thereof as shown in FIG. 9. The slide mount 172 includes a slot 174 with a bolt, screw or other mechanical fastener 176 captured therein and pivotally connecting a lower end of the rear brace 164. As such, the brace assemblies 160 at the lateral ends of the swing trainer 150 allow for individual adjustment in positioning of the track 154 according to the requirements and preferences of the golfer utilizing the swing trainer 150 of this embodiment.

With continued reference to FIGS. 9 and 10, the swing trainer 150 according to this embodiment includes a carriage 178 mounted for movement along the track 154 as controlled by a servo motor 180 and a controller 182. The carriage 178 includes a carriage plate 184 with an extension 186 projecting perpendicularly thereto. A T-shaped pillar 188 is pivotally coupled at 187 to the extension 186 and includes a trough or groove (not shown) in an upper face thereof. The shaft 12 of the golf club or putter 14 is seated within the groove and a keeper plate 190 having a similar and complimentary shaft or groove on the inner face thereof is secured by a pair of set screws 192 to the upper portion of the pillar 188 to capture the shaft 12 of the club 14. The pivotal coupling between the extension 186 and the pillar 188 allows for angular adjustment of the orientation of the shaft 12 during the putting stroke.

The carriage plate 184 includes a pair of similarly configured hubs 194 mounted to a bottom face of the carriage plate 184 as shown in FIG. 10. Each hub 194 is a mirror image of the other hub and includes a generally L-shaped configuration with a stud 196 projecting in the end of the hub 194. Each stud 196 has a roller 198 mounted for rotation between a pair of end plates 200 which retain an axle (not shown) on which the roller 198 is mounted. Each roller 198 is seated within one of the grooves 156*a*, 156*b* of the track 154 as shown particularly in FIG. 10.

The carriage plate 184 likewise has a mounting block 202 projecting rearwardly on a bottom end of the carriage plate 184. A belt 204 is secured to the mounting block 202 as shown in FIG. 10 to direct the movement of the carriage 178 and golf club 14 attached thereto relative to the track 154.

Referring particularly to FIG. 9, the belt 204 is trained around a series of pulleys and driven by the servo motor 180 to direct the swing of the golf club 14 via the carriage 178 per the controller 182. The belt 204 is trained around a pair of upper pulleys 206*a*, 206*b* mounted proximate opposite ends of the track plate 158. The belt 204 is also trained around a tensioning mechanism 208 which includes a tensioning plate 210 pivotally mounted to the track plate 158 at one end by pin 219 and a tensioning pulley 212 at the opposite end of the plate 210. The tensioning plate 210 is biased by a coil spring 214 secured by a pin 216 at a distal end of the spring 214. A pin 218 at the proximal end joins the spring 214 to the tensioning plate 210. Adjacent to the tensioning mechanism 208 is a feed pulley 220 which directs the belt 204 to the carriage 178 as shown in FIG. 9.

In a typical putting stroke, the golfer's weight does not shift and, as a result, the robotic arm is not required, but could be used in the golf swing trainer 150 of the embodiment shown in FIGS. 9 and 10. Likewise, a typical putting stroke does not require changing planes of the club shaft nor wrist brake or club face rotation so the components of the golf swing trainer of FIGS. 9 and 10 are particularly adapted for the putting stroke.

The golf swing trainer according to various embodiments of this invention is unique in that it allows for the complex motions involved in the expert golf swing that no other known track based system has heretofore been able to accomplish. Additionally, the trainer has the capacity for precise real time computer input into the controller 44, 182 and storage of the golfer's swing while in passive mode and can analyze variations in the golfer's swing from the expert model swing and can then subsequently suggest swing path modifications of the golfer's flawed swing through active (motorized) guiding of the golfer while he/she is holding onto the golf club in a golf swing motion.

The computer controller 44, 182 will also be able to teach specific corrections to the individual golfer 24 incrementally in small steps by asking the golfer 24 to repeat in passive mode what the trainer 10, 150 has shown in active mode. If the golfer is able to repeat the proper swing sequence as suggested by the controller 44, 182 then the trainer 10, 150 can progress to further swing modifications or elaborate those already identified and only incrementally taught. In this way, golfers of all abilities can approach the well-executed swing model through a series of instructions controlled by the pace and demonstrated ability of the golfer. No other known circular track guided system is designed to allow such incremental guiding and teaching.

In the physical training mode, the golfer's muscles are trained in the correct swing sequence by receiving electrical impulses by the servos from the controller and allowing variable resistance against which the golfer exerts force targeting those muscles involved in the model swing sequence. These computer controller guided movements strengthen those specific muscles involved in the model swing with both isotonic and isometric exercise instructions and the controller can sense through its servos the muscular exertion (i.e., resistance from the golfer to the proper swing) applied by the golfer and again critique the golfer's technique and progressively grade, monitor and guide progress.

The swing trainer is designed initially to be used in conjunction with golf teaching professionals to enable those professionals to better analyze their golfer's swing flaws which frequently can be difficult to recognize even with current video systems. One major advantage of this invention, however, is that it allows the golf professional to guide in real time the golfer's swing in an infinite number of ways to point out the correct feel of the well-executed swing and to be able to do so at real time speeds found in the full swing.

This swing trainer may also be available to any golfer without concomitant professional human coaching. The student golfer no longer has to coordinate his/her schedule with that of a busy golf professional who may or may not remember the golfer or his/her swing flaws, or to take time out to go to the gymnasium to train with a physical trainer who may or may not be knowledgeable in the field of golf. The golfer can get personalized, progressive, consistent, expert training in physical muscular training and at the same time and place and receive personalized, progressive, consistent, expert training in the efficient kinematic golf sequence of an expert model.

Carrier Servo Motor Requirements

Servo motor 46 moves an approximate 2 lb belt 31 along the inner wall of an aluminum circular track 16 in an omega style drive which is attached to an approximate 8 lb carriage plate around a 26 inch radius track at speeds not to exceed 4600 cm/sec from dead stop at bottom (impact and start position) over 215 cm in 0.8 sec to stop at top. Then from a stop at top accelerating over a distance of 215 cm achieving a speed no greater than 4600 cm/sec at impact at bottom in 0.4 sec followed by corresponding deceleration over another 215 cm in follow through again to dead stop.

When one swings a golf club, his/her hands are moving with heavy arms and probably more than 10 lbs considering the moments and all of the arms. The servo motors on the robotic arm 32 are moving much slower and are not stressed nearly as much as they would be in the much faster downswing; however, the centripetal force of the carriage acting in concert with gravity will naturally recreate the return of all servo movements created by backswing to neutral or start/impact position at impact. If one keeps all muscle control (motor forces) out of the downswing, the arms and club will naturally fall back along original swing plane (elevator scissors refold to down position), wrists uncock (articulating rod rotate back to start neutral position), club face rerotates also back to original square start position (shaft rotator rotates back to neutral at impact and continues past in follow through). Bad swings with the learning golfer fighting the trainer 10 will obviously need to be corrected by the controller 44 and the loads can be considerable, but even then they are likely to be less than noted above.

The swing trainer controller 44, 182 will include data to create a model to guide the student golfer. There are three-dimensional spatial devices currently on the market that can follow marker transmitters worn by the golfer and translate those points wirelessly to a computer and thereby onto a screen for viewing and analysis. This data can be accessible for use in this invention. Another option is to run a video of a golfer's swing and identify the point on the golf club shaft where the end effector attaches (just below the grip). Two views at a minimum would be needed, but three or more would be necessary. The computer controller graphically follows that point in real time to provide input for the model swings the trainer will be using as guides for the golfer. This method would also allow inputting old videos of golfers from times past, which are public domain and allow a much wider and interesting database.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A golf swing trainer for a golfer, the trainer comprising:

a generally arcuate track adapted to have a golfer positioned relative to the track and address a golf ball while gripping a golf club;

a support system supporting the track above the ground;

a carriage mounted on the track for movement thereon;

a robotic arm coupled to the carriage;

an end effector on a distal end of the arm adapted to grip the golf club;

a plurality of servo motors each operatively coupled to selected ones of the track, carriage, arm or end effector; and a controller electrically coupled to the servo motors to provide instructions for movement of the carriage, arm and end effector to move the golf club and guide the golfer through a specified golf swing.

2. The trainer of claim 1 wherein a first one of the servo motors is on the end effector and operative to rotate the golf club about a longitudinal axis of a shaft of the golf club.

3. The trainer of claim 2 wherein a second and a third servo motor are each mounted proximate a distal end of the arm and operative to move the golf club in respective planes perpendicular to one another;

a fourth and a fifth servo motor are each mounted proximate a proximal end of the arm and operative to move the golf club in respective planes perpendicular to one another; and a sixth servo motor is mounted proximate the track and operative to move the carriage relative to the track.

4. The trainer of claim 1 wherein a first and a second servo motor are each mounted proximate a distal end of the arm and operative to move the golf club in respective planes perpendicular to one another.

5. The trainer of claim 1 wherein a first and a second servo motor are each mounted proximate a proximal end of the arm and operative to move the golf club in respective planes perpendicular to one another.

6. The trainer of claim 1 wherein a first one of the servo motors is mounted proximate the track and operative to move the carriage relative to the track.

7. The trainer of claim 6 further comprising:

a belt coupled to the carriage and driven by the first one of the servo motors.

8. The trainer of claim 1 wherein the track is a closed, generally circular member adapted to receive the golfer standing therein when swinging the golf club.

9. The trainer of claim 1 wherein the support system is adjustable to selectively change a position of the track relative to the ground.

10. The trainer of claim 1 wherein the support system further comprises:

a plurality of adjustable legs each projecting from the track at proximal end of the leg and engaging the ground at a distal end of the leg.

11. The trainer of claim 1 wherein the controller is programmable to move the golf club at a desired rate, up to and including a full-speed golf swing.

12. A golf swing trainer for a golfer, the trainer comprising:

a generally arcuate track adapted to have a golfer positioned relative to the track and address a golf ball while gripping a golf club, wherein the track is a closed, generally circular member adapted to receive the golfer standing therein when swinging the golf club;

a support system supporting the track above the ground, wherein the support system is adjustable to selectively change a position of the track relative to the ground;

a carriage mounted on the track for movement thereon;

a robotic arm coupled to the carriage;

an end effector on a distal end of the arm adapted to grip the golf club;

a plurality of servo motors each operatively coupled to selected ones of the track, carriage, arm or end effector;

a first one of the servo motors is on the end effector and operative to rotate the golf club about a longitudinal axis of a shaft of the golf club;

a second and a third servo motor are each mounted proximate a distal end of the arm and operative to move the golf club in respective planes perpendicular to one another;

a fourth and a fifth servo motor are each mounted proximate a proximal end of the arm and operative to move the golf club in respective planes perpendicular to one another;

a sixth servo motor is mounted proximate the track and operative to move the carriage relative to the track;

a belt coupled to the carriage and driven by the sixth servo motor;

a controller electrically coupled to the servo motors to provide instructions for movement of the carriage, arm and end effector to move the golf club and guide the golfer through a specified golf swing.

13. A putting trainer for a golfer, the trainer comprising:

a generally arcuate track adapted to have a golfer positioned relative to the track and address a golf ball while gripping a putter;

a support system supporting the track above the ground;

a carriage mounted on the track for movement thereon with the carriage gripping the putter;

at least one servo motor operatively coupled to the carriage; and a controller electrically coupled to the servo motor to provide instructions for movement of the carriage to move the putter and guide the golfer through a specified putting stroke.

14. The putting trainer of claim 13 further comprising:

a belt coupled to the carriage and driven by the servo motor.

15. The putting trainer of claim 14 further comprising:

a tensioning mechanism coupled to the belt to maintain tension in the belt.

16. The putting trainer of claim 13 wherein the support system is adjustable.

* * * * *